US005174688A

United States Patent [19]

Meheen

[11] Patent Number: 5,174,688

[45] Date of Patent: Dec. 29, 1992

[54] RETAINING WALL WITH TIE-BACK ELEMENTS AND TIED ARCH

[76] Inventor: H. Joe Meheen, 1860 Lincoln St., Denver, Colo. 80295

[21] Appl. No.: 752,837

[22] Filed: Aug. 30, 1991

[51] Int. Cl.[5] ..... E02D 29/02

[52] U.S. Cl. ..... 405/284; 405/262; 405/286

[58] Field of Search ..... 405/31, 258, 262, 273, 405/284, 285, 286

[56] References Cited

U.S. PATENT DOCUMENTS 4,278,364 7/1981 Frehner ..... 405/273
4,658,541 4/1987 Haile ..... 405/284 X
4,798,499 1/1989 Yamada ..... 405/286
4,920,712 5/1990 Dean ..... 405/286

*Primary Examiner*—David H. Corbin
*Attorney, Agent, or Firm*—Richard W. Hanes

[57] ABSTRACT

A modular assembled retaining wall is constructed by placing a plurality of precast tie-back elements in laterally spaced relationship along a grade line. A novel soil retaining panel is provided. The panel includes a curved rear wall meeting a flat front wall at curved ends which mate with vertical ribs of each tie-back. A novel method is also provided for simultaneously casting two tied arch-shaped soil retaining panels out of low water-to-cement ratio concrete.

2 Claims, 3 Drawing Sheets

Fig_1
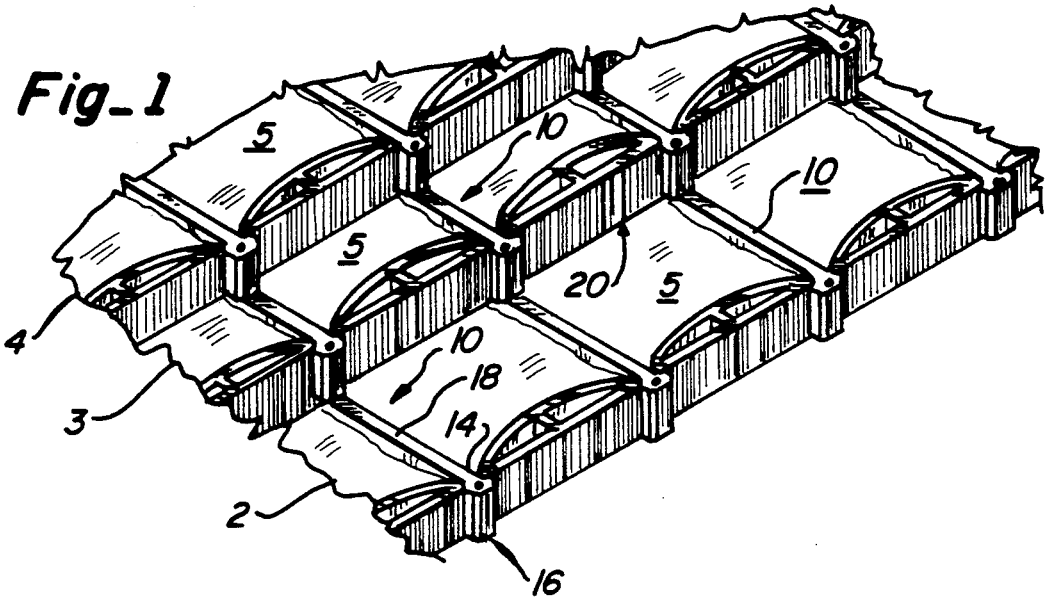
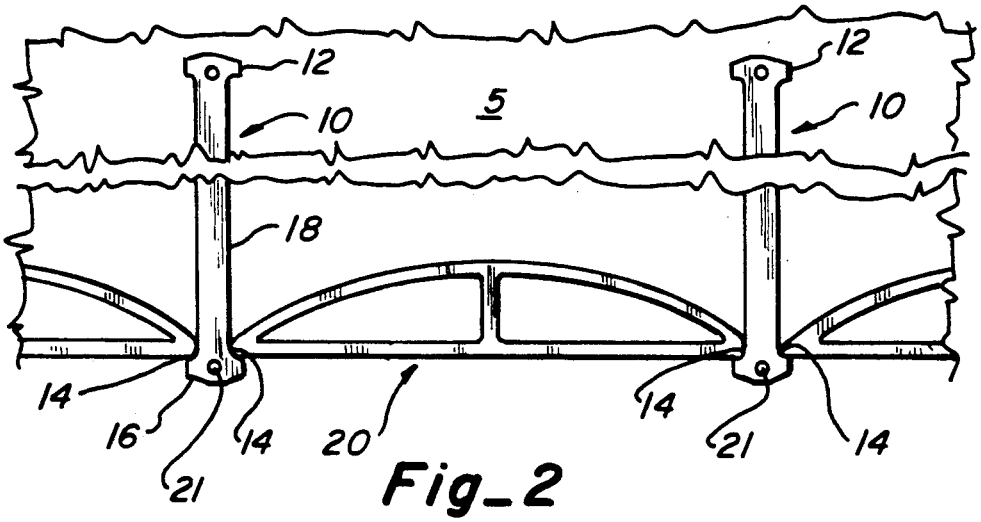
Fig_2
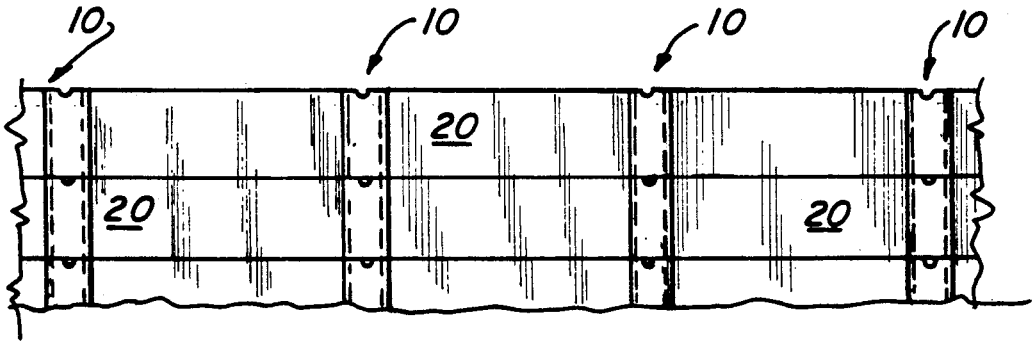
Fig_3

RETAINING WALL WITH TIE-BACK ELEMENTS AND TIED ARCH

BACKGROUND OF THE INVENTION

The instant invention relates to a modular assembled retaining wall formed of precast concrete. The retaining wall can be used for landscaping, terracing, slope protection, noise barriers, and erosion control.

In the past, retaining walls have been formed of a plurality of standardized block units which have been assembly one on top of each other to a desired elevation without the use of mortar. Such a system is shown in U.S. Pat. No. 3,282,054. In the prior art, the entire retaining wall uses the same basic foundation since each of the blocks of the entire wall rests on and is dependent upon the blocks immediately below. This limits the versatility and application of the wall. This stacking of blocks can also result in compacting of the soil fill.

Other prior art systems require interconnections of elements or timed assembly which limits versatility.

U.S. Pat. No. 4,050,254 to Meheen et al. discloses a modular retaining wall system having a plurality of precast tie-back elements in a laterally spaced relationship along a grade line. The tie-back elements includes upright columns against which a retaining panel is arranged to span the lateral space between pairs of tie-back elements. The panels of this patent have a concave cross-section, i.e., circular or elliptical arch, in horizontal plan view so as to resist the load from the compacted soil fill in compression. A disadvantage of the arched panels of the patent lies in the fact that the panels could be subject to cracks if the ends of each panel were not completely contained or covered by the tie-back members.

Another prior art curved retaining wall system is shown in U.S. Pat. No. 4,341,491 to Neumann. The patent discloses curved frontal wall panels mounted to frontal wall support members which are in turn attached to a curved rear wall through tension members. Such a system is quite complex, and again, the front curved panels can be subject to cracking.

The prior art curved wall panels disclosed above were each cast separately which can also be a time-consuming and expensive procedure.

It is an object of the instant invention to provide a retaining wall system which uses a tied arch for the wall panel.

It is a further object of the instant invention to provide a wall panel for a retaining wall which can resist cracking under bending stresses.

It is an additional object of the instant invention to provide a method for simultaneously casting a plurality of tied arches for a retaining wall.

It is a further object of the instant invention to provide a wall panel for a retaining wall which has an attractive patterned frontal flat face.

SUMMARY OF THE INVENTION

The present invention provides a retaining wall and method which utilize modular structural units, such as precast strengthened concrete units, which may be mass produced away from the construction site, stored as desired, and then easily erected with a minimum of skill and supervision. More specifically, a novel "tie-back" component is provided for placement and support of soil retaining panels and for transmitting soil pressures on such panels back into the soil mass while resisting pullout or other unwanted movement of the wall. The result is a retaining wall possessing high strength, stability, and durability.

In the retaining wall system of the present invention, a plurality of retaining wall tiers can be erected independently of each other to a desired elevation in a continuous sequential fashion or at desired intervals.

Objectives of the invention are achieved by utilizing a plurality of tie-back elements comprising integral wall forming and wall retaining structure. These stress supporting and transmitting components are placed on a suitable foundation above which an embankment is to be constructed utilizing soil fill to another grade level. Retaining panels span the lateral space between adjacent pairs of such tie-back elements without any positive interconnection between these module structures.

In the preferred embodiment, the tie-back element include a vertical column having a curved rib portion for mating with the wall retaining panel. The soil or wall retaining panel is in the form of a tied arch having an elliptically curved rear panel and a substantially flat front panel. The elliptical rear panel and the substantially flat front panel together form curve ends which mate or interlock with the ribs of the tie-back column.

The tie-back elements include horizontally oriented leg means which project into the embankment a substantial distance from the base of the column so as to transmit pressure from the retaining panels back into the earth's mass. The height of the column portions of the tie-back elements can very depending on the particular embankment to be constructed. The length of the horizontal leg portion and ratio of the length of the horizontal leg portion to length of the column means is largely a function of soil stability conditions.

The invention also provides a method of simultaneously casting two tied arch retaining panels utilizing low-slump type concrete. The arches are cast as siamese twins mating along their flat frontal face. Cracking along the front face or the use of rods or other structural elements to assist the break can achieve desirous attractive effects.

Other features and advantages of the present invention will be brought out in the following more detailed description of a specific embodiment made in conjunction with the accompanying drawings.

BRIEF DESCRIPTION OF THE DRAWINGS

FIG. 1 is a prespective view, with portions cut away, of a multi-tier embankment embodying the invention.

FIG. 2 is a top view, with portions cut away, of a tier of the embankment embodying the invention.

FIG. 3 is a front view, with portions cut away, of the embankment and retaining wall structure of FIG. 1.

DESCRIPTION OF THE PREFERRED EMBODIMENT

Figure 7:
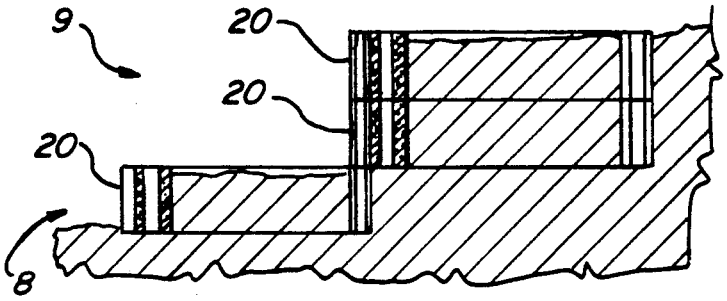
FIG. 7 is a cross-sectional view of a multi-tier embankment, with portions cut away, embodying the invention in a stacked form.

Retaining wall structure for an embankment constructed in accordance with the invention includes tiers 2, 3 and 4 which retain soil fill 5 at different grade elevations (see FIG. 1). Such an embankment may exist, for example, on either shoulder of road, i.e., below road level to support the road or above road level to maintain a protective slope. Each of the retaining walls of tiers 2, 3 and 4 are constructed from modular components consisting essentially of two basis parts; one being a tie-back means 10 and the other being soil retaining means 20. The soil retaining means 20 can be made in one piece or can be stacked as shown in FIG. 7.

Referring to FIGS. 1 and 2, tie-back element 10 includes a vertically-oriented column 16 and 18, the latter being with the base of column and projects backwards from column means to anchor the tie-back. The overall length of leg means 18 is preferably at least equal to the height of the column means 16.

Referring to FIGS. 1 and 2, column 16 of the tie-back elements includes a pair of elongated recesses 14 extending along opposite sides of the column for receiving the longitudinal opposite ends of panels 20 during assembly. The front portion 20 of column 16 of the tie-back element is provided with a hole or bore 21 for the purpose of receiving rods to align and tie the columns 16 when they are stacked one on top of the other. The transverse cross-sectional configuration of column 16 is selected to provide adequate strength for reception of force applied through the retaining panels and to provide compactness, ease of manufacture, and to reduce likelihood of fracture during handling.

A leg 18 extends backward from each column 16 for each tie-back 10. Each leg 18 has a length chosen so that when the tie-back 10 is installed during construction there will be sufficient frictional resistance to prevent pull-out or dislodgement of the tie-back element 10 by virtue of retained soil. The leg portion 18 terminates with a second column 12 substantially identical to the first column 16. The greater transverse or width dimension of the second column 12 with respect to leg 18 of each tie-back 10 enhances the frictional resistance of the tie-back 10 and aids in preventing dislogdement.

The symmetrical shape of each tie-back allows for ease in casting, fabrication and use. The installer does not have to differtiate between the front or rear column in installation. The tie-backs and the tied arches may be easily molded with low-slump concrete, plastic or shaped from steel or wet cast in a concrete form.

Figure 5:
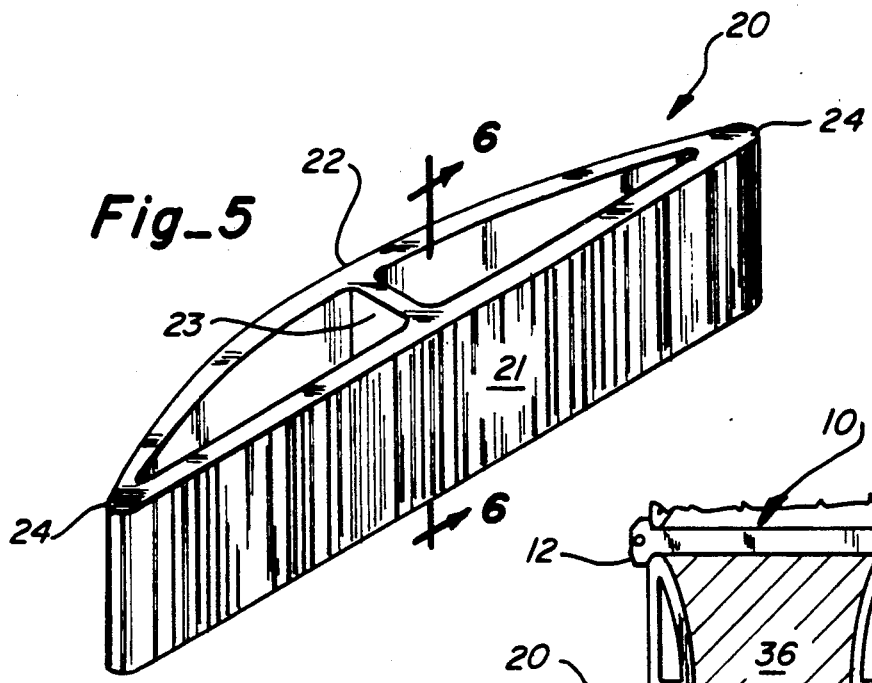
FIG. 5 is an enlarged perspective view of the soil retaining panel of the instant invention.
Figure 6:
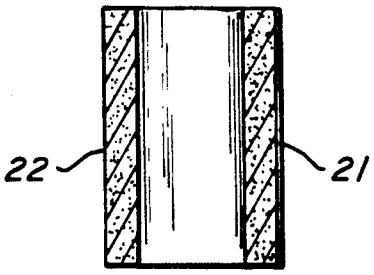
FIG. 6 is a cross-sectional view of the panel of FIG. 5 taken along line 6—6.

The novel retaining wall or soil retaining panels 20 can also be cast prior to delivery and assembled on site. Each panel 20, as shown in FIGS. 5 and 6, comprises a substantially flat frontal face or wall 21 and a curved rear face or wall 21 to form a tied arch. The rear face 22 is preferably elliptical in shape, although other shapes can be used. For added strength, a middle span 23 is also provided. The front face 21, middle span 23, and rear face 22 are cast together as a unitary unit. The curved end 24 of the panel formed where the front face meets the rear face interlock and meet the ribs 14 of the tie-back 10 in use.

Each panel or tied arch is preferably cast of low-slump concrete, or concrete with a low water-to-concrete ratio, similar to that used for the tie-backs.

Figure 8:
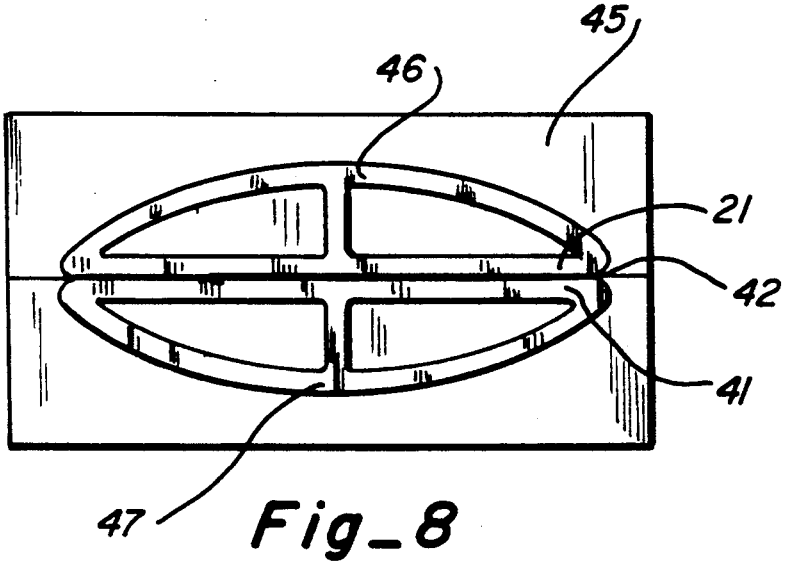
FIG. 8 is a top view diagrammatically illustrating a casting mold.

Although each panel or tied arch 20 can be cast separately, a method is provided for casting two panels, or two tied arches 20 and 40, together at one time. The method provides making a mold 45 having two semi-elliptical channels 46 and 47, each having first and second ends, and one substantially straight channel meeting each of the first and second ends of the semi-elliptical channels (see FIG. 8). Thus, the frontal faces of both walls 21 and 42 are cast together to be split in two later in accordance with known methods. The splitting of the two frontal panels can produce an attractive and decorative appearance on the frontal face, as shown on panel 21 in FIG. 5. The flat frontal face panel is also considered more aesthetically pleasing by some architects than the curved face panel of the prior art. Other well known materials can also be placed between the walls 21 and 41 to achieve the desire attractive effect upon splitting.

In constructing an embankment with a retaining wall system including a plurality of tiers such as 2, 3 and 4, the lower tier is first constructed by initially placing the tie-backs 10 at approximately 3-foot centers on a suitable foundation approximately 9 inches below the grade level (not shown). Tie-back elements 10 are placed with front column portions 16 extending substantially vertically upright with leg portions 18 extending back therefrom. While the column means 16 may be angled toward the embankment, it would not ordinarily be angled opposite where normal soil retaining functions are being performed.

After tie-backs 10 are properly positioned in laterally spaced relationship transverse to a central axis extending into the embankment, individual tied arch panels 20 are placed between each tie-back. Opposite ends 24 of such panels are received in the elongated recesses 14 of the column portions 16 of the tie-back elements 10. As placement of the panels proceeds, soil fill 5 is introduced behind panels 20 and around the leg portions 18 and firmly compacted against the panels 20 and leg portions 18. When placing fill around tie-back elements at the end of a tier, where insufficient end abutment exists, it is preferable to hold the tie-backs together to prevent spreading as the fill is being paced. This may be effected, for example, by cables and the like. Depending on local conditions at the construction site, any suitable drainage means (not shown) may be incorporated if desired in the soil fill 5 to ensure proper drainage. Also, it should be noted that because of the offset tier construction of the present invention, the retaining wall system will be free of large hydrostatic pressures.

Figure 9:
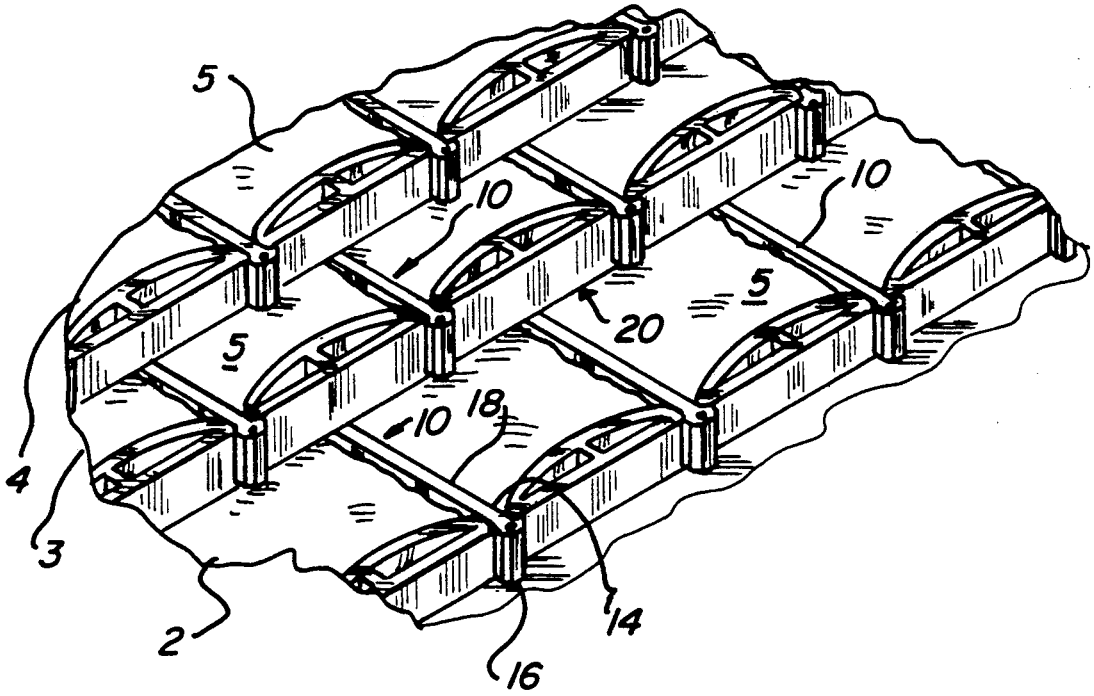
FIG. 9 is a perspective view, with portions cut away, of a multi-tier embankment embodying the invention where adjoining tiers are staggered.

After the lower level tier 2 is constructed, the second tier 3 is constructed above tier 2 using the same assembly method. The locations of the tie-back elements 10 in the second and third tiers can be staggered with respect to the locations of the tie-back element in the first tier, if desired, as shown in FIG. 9.

Subsequent tiers, erected in the same manner, can be erected immediately after the lower tiers are erected or at later time since each of the tiers are self-sustaining and do not require the support of the tiers above.

Panels 20 are retained in place against the tie-back elements by means of the pressure of the soil fill 5 behind the panels. The elliptical curvature of the rear face of the panels and their placement with the convex surface facing inwardly to receive the soil fill, permit the panels to absorb the soil fill loads largely in compression. Outward movement of panels 20 under the pressure of the soil fill 5 is prevented by the column 16 of the tie-back elements. This load on the vertical column 16 of each tier is transferred back into the soil and the earth's mass through the leg 18 and the columns 16 embedded in the soil. In this way, each tier is self-sustaining. The retaining panels also present an attractive appearance with their flat decorative frontal face.

The present invention enables the area of a mountain terrain on which an embankment is to be constructed to be minimized. Thus, fill slopes may be constructed within a relatively small area close to a roadway shoulder instead of distributing fill over a large area of mountain terrain with an extended length slope. In conventional fill slope practice, about 2 feet of horizontal displacement is normally required for each foot of vertical rise. Along the down side of a mountain slope or hillside this horizontal displacement can become indeterminate. The present invention overcomes this problem and also decreases the horizontal displacement required to a low as one-half foot for each foot or rise with the staggered tier arrangement of FIG. 1. Therefore, the overall angle of inclination of a slope formed by an imaginary line through a mean point in each tier of the present invention can be substantially steeper than what would otherwise be available. Also, wash and other related problems known in the art are substantially reduced or eliminated by the present invention.

Figure 4:
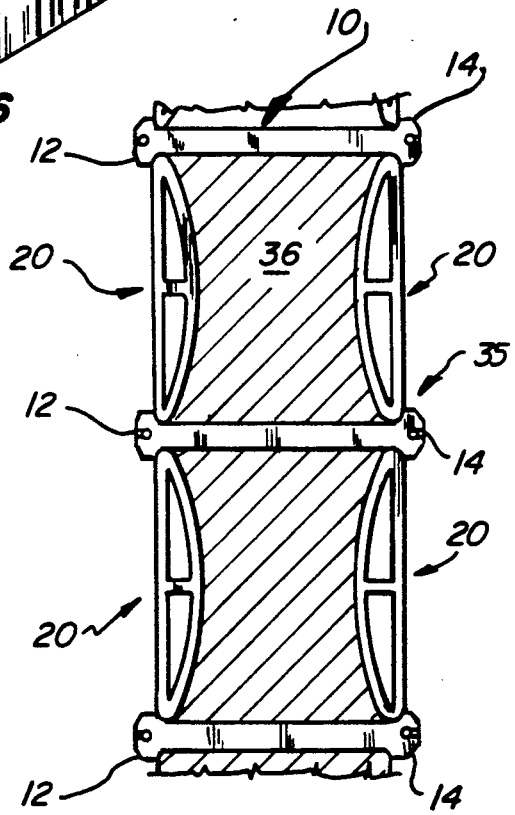
FIG. 4 is a top view of a noise barrier wall embodying the instant invention.

The modular retaining wall structure of the instant invention can also be used to erect a noise barrier wall as shown in FIG. 4. As both columns 14 and 12 of each tie-back 10 are substantially identical, a panel 20 can nest or mate against each column 12 and 14. The enlarged size of each column 12 and 14 aids in retaining the panels 20 in place against the force of the soil. Fill dirt 36 can be placed in the resulting wall structure 35 shown in FIG. 4 to achieve an effective noise barrier wall.

FIG. 7 illustrates a further modification. In the second tier 9 of the resulting wall, retaining panels 20 are stacked, along with their tie-backs (not shown), to achieve the desired height for the tier 9. Tier 8 is of the single panel height configuration of the preferred embodiment.

Strengthened precast concrete structures are practical and economical for most applications of the invention, however, the modular elements could be constructed from other suitable materials such as steel, plastic reinforced fiberglass, etc.

In the light of the present techings, various wall shapes and configurations can be devised without departing from the principles of the present invention. Such modifications and configurations would be obvious to one of ordinary skill in the art.

I claim:

1. Structure for a modular assembly for retaining soil along an embankment, comprising in combination, at least a pair of laterally spaced tie-back elements, each tie-back element comprising a web interconnecting a pair of spaced apart vertically oriented columns, each said column comprising at least one laterally projecting vertically oriented lip, a soil retaining panel extending between said pair of tie-back element, said retaining panel comprising, an arcuate rear wall, a substantially flat chordal front wall whose lateral extremities are integral with the lateral extremities of the arcurate rear wall, forming first and second rounded ends of the panel, and where the front and rear walls are vertically co-extensive, and including at least one stress web interconnecting the front and rear walls, disposed perpendicularly to the front wall, defining at least a pair of tubular passages through the panel, said first and second rounded ends on said panel each being disposed in mating relationship against the lip and the web on one of said pair of tiebacks, wherein said tie-back elements hold said retaining panel against horizontal outward movement away from the embankment under the pressure of the retained soil.

2. A modular retaining wall system for retaining soil along an embankment, the system comprising, a plurality of individual retaining wall tiers arranged one above the other and offset inwardly toward the embankment with respect to each other for holding an embankment of compacted soil and similar fill material, each of the plurality of such tiers being assembled from modular structures comprising tie-back elements in laterally spaced relationship with soil retaining panels extending between such space between adjacent pairs of tie-back elements, each tie-back element comprising a web interconnecting a pair of spaced apart vertically oriented columns, each said column comprising at least one laterally projecting vertically oriented lip, a soil retaining panel extending between said pair of tie-back elements, said retaining panel comprising, an arcuate rear wall, a substantially flat chordal front wall whose lateral extremities are integral with the lateral extremities of the arcuate rear wall, forming first and second rounded ends of the panel, and where the front and rear walls are vertically co-extensive, and including at least one stress web interconnecting the front and rear walls, disposed perpendicularly to the front wall, defining at least a pair of tubular passages through the panel.

* * * * *